United States Patent [19]

Hirano

[11] Patent Number: 4,616,600

[45] Date of Patent: Oct. 14, 1986

[54] CYLINDER BLOCK FOR INTERNAL COMBUSTION ENGINE

[75] Inventor: Yoshinori Hirano, Yokohama, Japan

[73] Assignee: Nissan Motor Co., Ltd., Yokohama, Japan

[21] Appl. No.: 556,384

[22] Filed: Nov. 30, 1983

[30] Foreign Application Priority Data

Dec. 1, 1982 [JP] Japan ..... 57-180563[U]

[51] Int. Cl.[4] ..... F01P 3/22

[52] U.S. Cl. ..... 123/41.21; 123/41.74; 123/41.79

[58] Field of Search ..... 123/41.2, 41.21, 41.72, 123/41.74, 41.79, 193 C

[56] References Cited

U.S. PATENT DOCUMENTS

| | | | |
|---|---|---|---|
| 1,731,016 | 10/1929 | Lehman | 123/41.2 |
| 4,131,093 | 12/1978 | Mansfield | 123/41.85 |
| 4,237,847 | 12/1980 | Baugh et al. | 123/41.72 |
| 4,329,947 | 5/1982 | Ishihara | 123/41.74 |
| 4,343,267 | 8/1982 | Shaw | 123/41.74 |
| 4,394,850 | 7/1983 | Hayashi | 123/41.74 |
| 4,470,376 | 9/1984 | Hayashi | 123/41.74 |

FOREIGN PATENT DOCUMENTS

| | | | |
|---|---|---|---|
| 0048020 | 3/1982 | European Pat. Off. . | |
| 0059423 | 9/1982 | European Pat. Off. . | |
| 0068179 | 1/1983 | European Pat. Off. . | |
| 0137328 | 4/1985 | European Pat. Off. . | |
| 299551 | 7/1917 | Fed. Rep. of Germany | 123/41.79 |
| 1088475 | 3/1955 | France . | |
| 57-1816 | 1/1982 | Japan . | |
| 143120 | 9/1982 | Japan | 123/41.72 |
| 183541 | 11/1982 | Japan | 123/193 C |
| 57-57608 | 12/1982 | Japan . | |

*Primary Examiner*—William A. Cuchlinski, Jr.

*Attorney, Agent, or Firm*—Schwartz, Jeffery, Schwaab, Mack, Blumenthal & Evans

[57] ABSTRACT

To increase the vibration damping structural rigidity of a cylinder block wherein the coolant jacket thereof is adapted to receive coolant in a liquid state and discharge same in a gaseous state, ribs are formed integrally between the outer wall of the coolant jacket and the cylinders surrounded thereby. With this arrangement as the coolant need not be forcefully circulated within the coolant jacket due to the nature via which heat is removed from the cylinders, the ribs may be formed in structurally advantageous positions wherein the coolant stagnating effect caused by same is not objectionable and wherein they simultaneously increase the surface area via which the coolant is heated.

6 Claims, 12 Drawing Figures

CYLINDER BLOCK FOR INTERNAL COMBUSTION ENGINE

BACKGROUND OF THE INVENTION

1. Field of the Invention

The present invention relates generally to an internal combustion engine and more specifically to an improved cylinder block construction which both improves the structural rigidity and cooling efficiency thereof.

2. Description of the Prior Art

In a conventional liquid cooled multi cylinder internal combustion engine cylinder block such as shown in FIG. 1 of the drawings, a suitable coolant such as water is forcefully circulated through the cylinder block 1, cooled in an air cooled heat exchanger or radiator (not shown) and recirculated back into the cylinder block 1. However, in such arrangements it is necessary, in order to achieve uniform cooling of the cylinders 2, to provide free fluid flow within the coolant jacket both between and around same. This introduces a problem in that the reinforcing interconnections between the cylinders 2 (which are cylindrical and structurally rigid) and the outer wall 3 of the cylinder block (which is flat and relatively flexible) are limited whereby the structural rigidity of the outer wall of the cylinder block tends to be inadequate. Accordingly, the wall tends to vibrate, especially under given modes of engine operation, and thus defines a source of noise.

In order to overcome this problem it has been proposed to use ribs and/or bolts to provide a partial connection between the cylinders and the outer wall. However, excessive use of same obstructs coolant flow undesirably. Further, the shape and location of the ribs is severely limited due to the internal flow requirement mentioned above. Accordingly, an engine block having a coolant jacket wall featuring a suitable level of rigidity has been difficult to obtain especially while maintaining the weight of same at a suitably low level.

More recently, a radically different type of engine cooling system such as shown in FIG. 2 of the drawings has been proposed. This system is disclosed in European Patent Application No. 0 059 423, published on Sept. 8, 1982. This system basically features an arrangement wherein the coolant in the coolant jacket 4 defined in the cylinder block 5, is permitted to boil and the gaseous and/or boiling coolant passed out through the cylinder head 6 to a compressor 7. The compressor 7 compresses the gaseous coolant raising the temperature and pressure thereof and pumps same into an air cooled heat exchanger (radiator) 8. Due to the high temperature differential between the atmosphere and the high temperature-pressure vapour, the cooling efficiency of this arrangement is remarkably high. Subsequent to condensation the coolant is recirculated back into the cylinder block by way of a reservoir 9 (including a liquid level sensor 10) and an expansion valve 11.

SUMMARY OF THE INVENTION

The present invention is based on the realization that, with the advent of the above mentioned type of cooling system it was no longer detrimental to stagnate the flow of coolant within the cylinder block and even advantageous to do so. Hence, the present invention features a cylinder block of the nature utilized in the above mentioned system, which includes reinforcing ribbing in the coolant jacket which ribbing simultaneously provides the long desired coolant jacket outer wall rigidity and increases the surface area via which the heat from the cylinders may be transferred to the coolant.

Accordingly, it is an object of the present invention to provide a unique cylinder block arrangement wherein both high cooling efficiency and noise generating vibration damping rigidity are simultaneously rendered possible without incurring excessive weight penalties.

More specifically, the present invention takes the form of an internal combustion engine wherein a cylinder block includes means defining a coolant jacket into which coolant is introduced in a liquid form and discharged in gaseous form, and a structure in the coolant jacket which increases the structural rigidity of the cylinder block and defines compartments in the coolant jacket in which the liquid coolant tends to stagnate.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Figure 1:
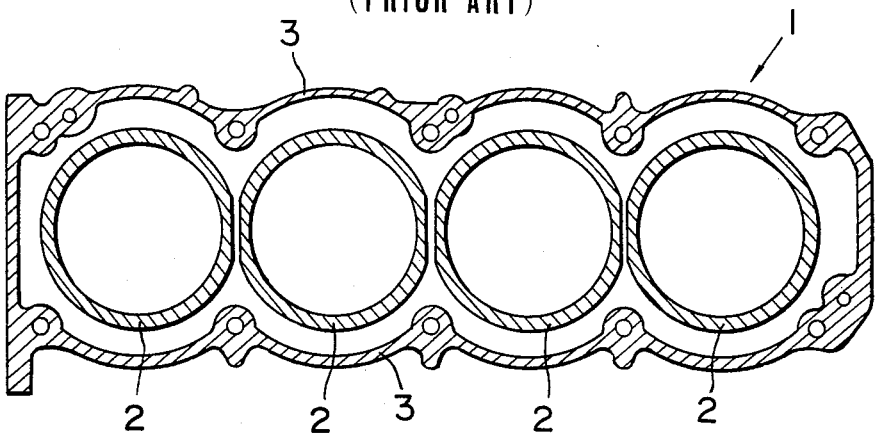
FIG.1 (PRIOR ART)
FIG. 1 shows the prior art arrangement discussed briefly in the opening paragraphs of the present disclosure.
Figure 3:
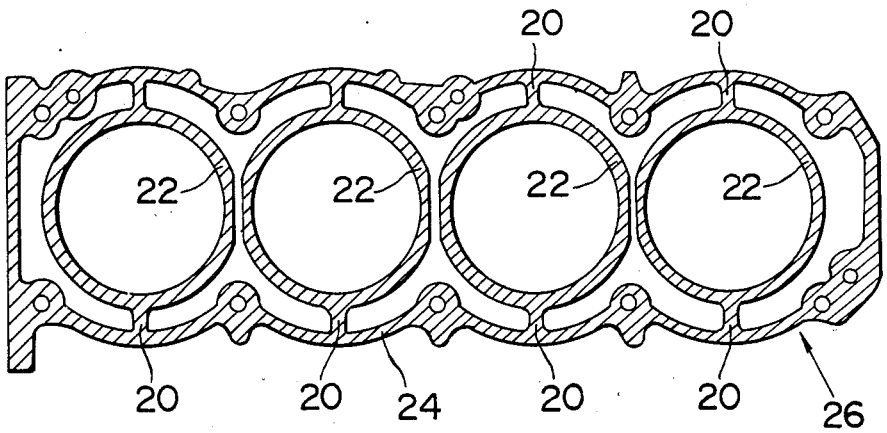
FIG. 3 is a sectional view of a first embodiment of the present invention.
Figure 2:
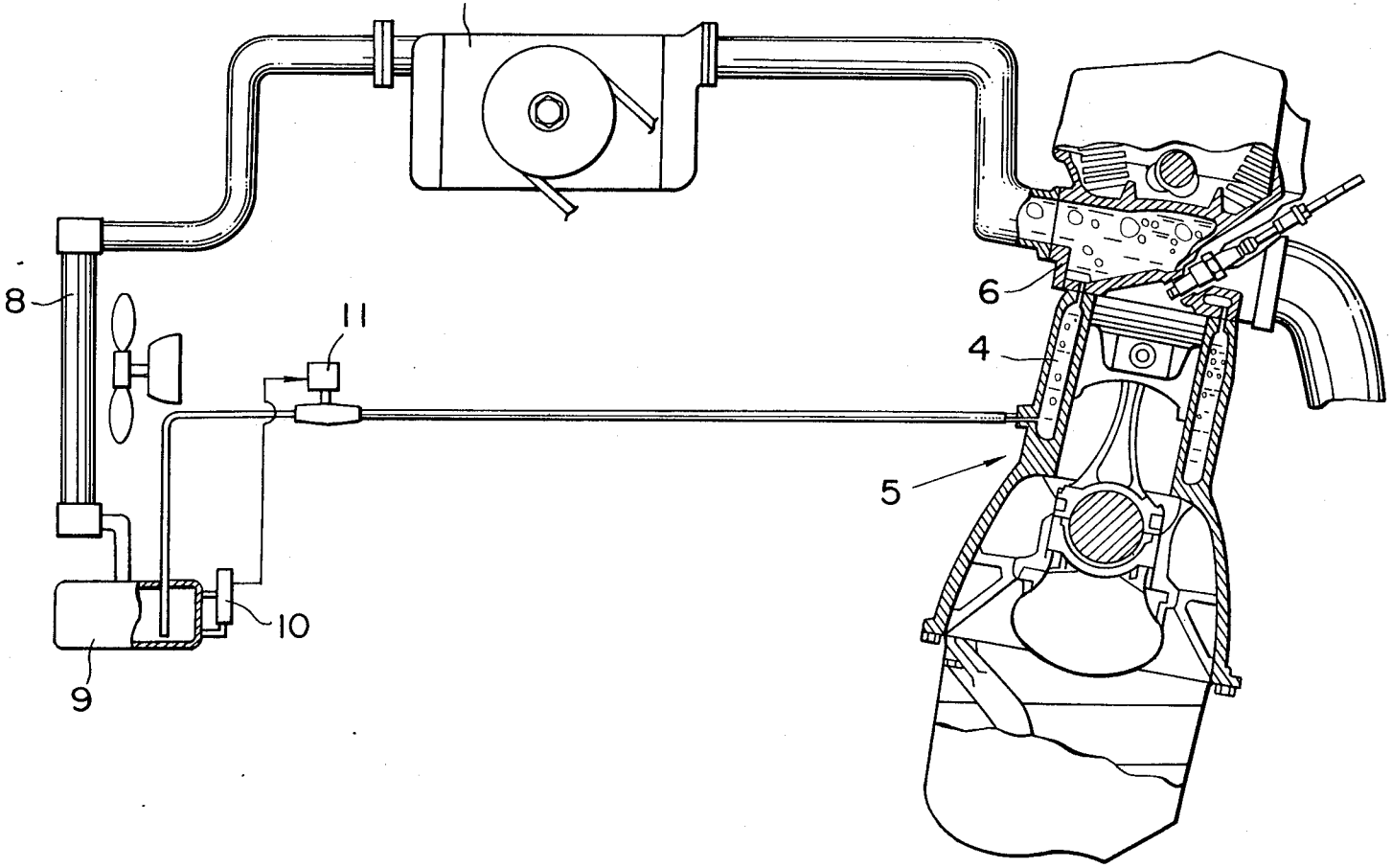
FIG. 2 (PRIOR ART)
FIG. 2 is a schematic elevation (partially in section) showing a previously proposed engine cooling system in combination with which the present invention finds particular application.
Figure 4:
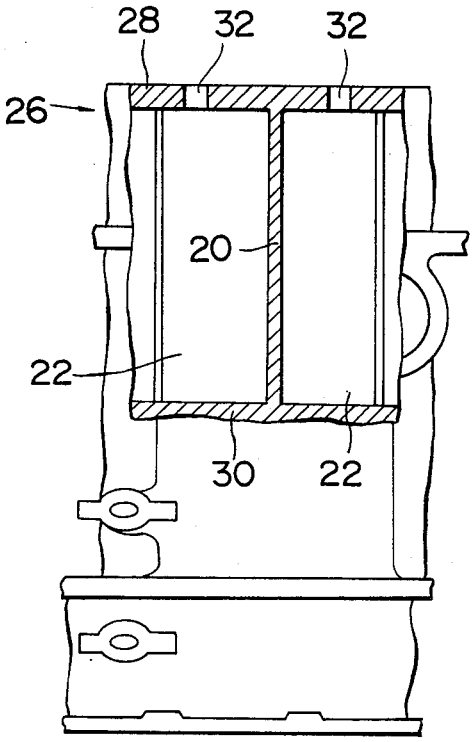
FIG. 4 is a sectional elevation of the arrangement shown in FIG. 3.

Turning now to FIGS. 3 and 4 a first embodiment of the present invention is shown. In this arrangement, web-like ribs 20 are formed between and integral with the cylindrical cylinders 22 and the outer walls 24 of the cylinder block 26. As previously mentioned, the cylindrical nature of the cylinders 22 endows on same a relatively high rigidity which when connected with the outer walls 24 of the cylinder block 26 secures same against diaphragm-like inward and outward flexure. The disposition of the ribs 20 in diametrically arranged pairs also serves to increase the structurally rigidity of the arrangement. As shown in FIG. 4, the ribs 20 in the first embodiment are arranged to extend continuously between the upper and lower decks 28, 30 of the cylinder block 26 endowing on same considerable resistance to the forces produced by the reciprocation of the pistons and associated rotation of the crank shaft, which tend to induce twisting and bending of the cylinder block per se. The upper deck 28 is formed with vent holes 32 through which the boiling coolant is discharged.

An advantage derived with this arrangement is that the cylinders are themselves reinforced against deformation by the ribs in a manner which facilitates the construction of long stroke or "under square" engines.

A further and more important feature of the present invention is that the ribs 20 serve to conduct heat away from the cylinders 22 and transmit same toward the outer walls 24. Accordingly, as the cylinder block 26 per se has a high heat accumulating capacity and the ribs 20 provide an increased surface area via which heat may be transmitted to the coolant, the cooling efficiency of the arrangement is notably increased.

Figure 5:
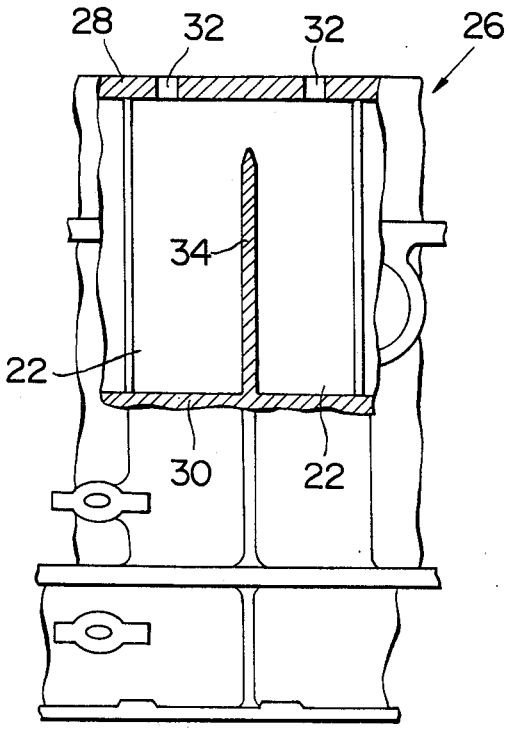
FIG. 5 is a sectional elevation showing a second embodiment of the present invention.

FIG. 5 shows a second embodiment of the present invention. In this arrangement ribs 34 are arranged to terminate short of the upper (and/or lower) deck 28. With this arrangement good structural rigidity (with attendant weight reduction) of the cylinder block is obtained despite the reduced size of the ribs. The length and other dimensions of the ribs should be selected in view of the vibrational characteristics of the engine and cylinder block to which the embodiment is applied.

Figure 6:
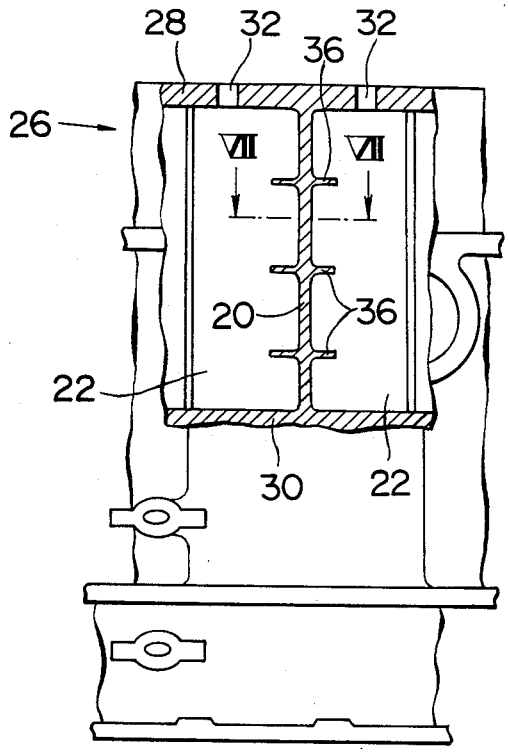
FIGS. 6 and 7 are sectional views showing a third embodiment of the present invention.
Figure 7:
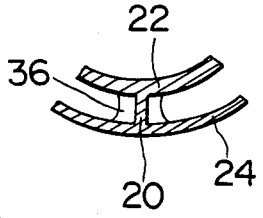

FIGS. 6 and 7 show a third embodiment of the present invention. In this arrangement additional ribbing or webs 36 are formed to extend essentially normally with respect to each of the main ribs 20. As will be appreciated, these additional ribs 36 function both as cooling fins and as reinforcing members. A notable increase in cylinder block rigidity is provided by this arrangement.

Figure 8:
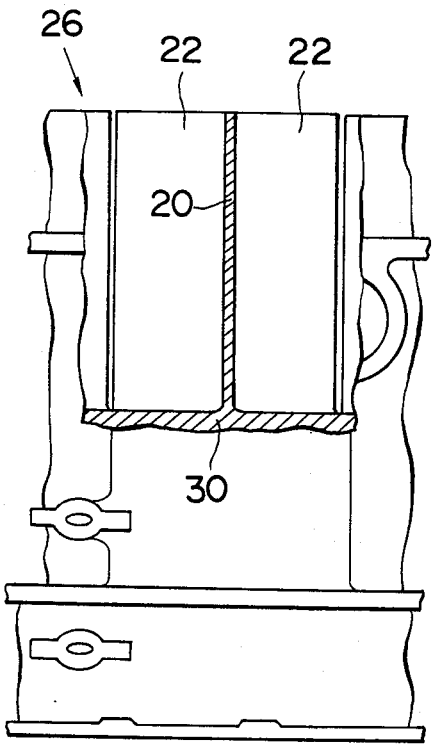
FIG. 8 shows a fourth embodiment of the present invention.

FIG. 8 shows a fourth embodiment of the present invention wherein the upper deck is omitted.

Figure 9:
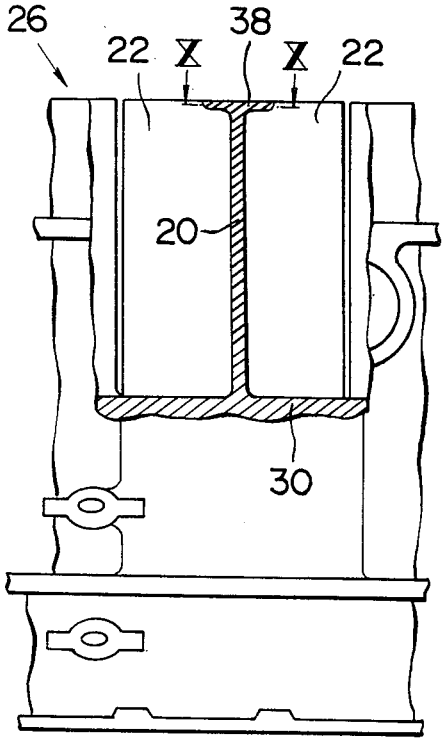
FIGS. 9 and 10 are sectional views of a fifth embodiment of the present invention.
Figure 10:
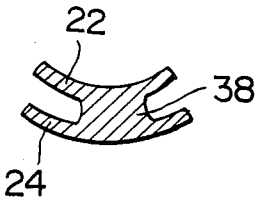

FIGS. 9 and 10 show a fifth embodiment of the present invention which is essentially the same as the fourth but with the exception that web-like ribs 38 are provided at the level of the upper deck. This embodiment increases the rigidity of the cylinder block as compared to the arrangement wherein the upper deck is completely omitted without rendering die casting of the block difficult.

Figure 11:
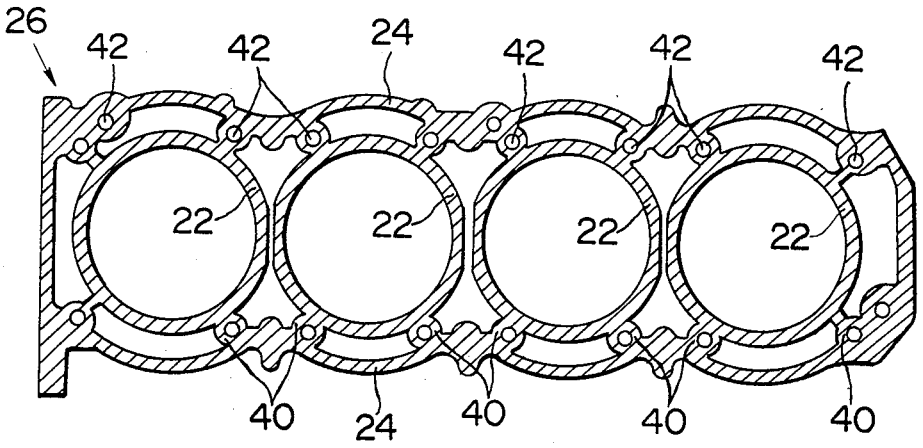
FIGS. 11 and 12 are sectional views of sixth and seventh embodiments of the present invention, respectively.

FIG. 11 shows a sixth embodiment of the present invention wherein four ribs 40 are provided per cylinder. These ribs are formed with tapped bores 42 which permit the head bolts used to secure the cylinder head to the block to be located closer than normal to the combustion chamber(s). This improves both the sealing between the head and the block and the rigidity with which the two members are secured together.

Figure 12:
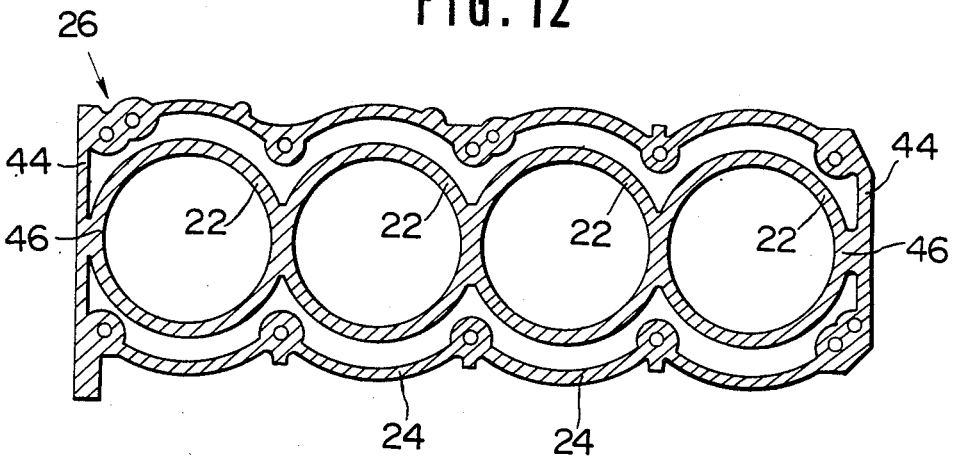

FIG. 12 shows a seventh embodiment of the present invention. In this arrangement the cylinders 22 are "siamesed" and connected with the end walls 44 of the cylinder block 26 by ribs 46. Of course ribs of the nature disclosed hereinbefore may also be provided in this embodiment. It will be noted that due to the efficiency with which heat may be removed from the cylinders using the technique disclosed hereinbefore, the circulation space normally required between adjacent cylinders may be completely omitted permitting close and rigid interconnection between the cylinders per se and a notable attendant reduction in the overall lenght of the cylinder block. This latter mentioned length reduction permits a compact arrangement which itself inherently increases the rigidity of the block.

Moreover, it is possible to merge the ribs formed in the coolant jacket with those formed on the skirt of the block (see FIG. 5 for example) to utilize the rigitiy of the rib-cylinder connection to increase the structural rigidity of skirting and to further attenuate vibration noise and block distortion.

What is claimed is:

1. In an internal combustion engine a cylinder block;

means defining at least one cylinder in said cylinder block;

a cylinder head attached to said cylinder block in a manner to close one end of said at least one cylinder and define a combustion chamber therein;

means defining a coolant jacket in said cylinder block, said coolant jacket surrounding said at least one cylinder;

a condenser in which gaseous coolant is condensed to its liquid form;

means for communicating between said cylinder block and said condenser for introducing liquid coolant from said condenser into said coolant jacket;

means for collecting gaseous coolant produced by the boiling of the liquid coolant introduced into said coolant jacket, said collecting means defining a cavity;

means for conveying the coolant collected in said cavity to said condenser for condensation therein;

an upper deck formed along the top of said cylinder block and against which said cylinder head is secured;

a lower deck formed along the bottom of said cylinder block;

at least one non-perforate rib member in said coolant jacket which extends between and interconnects said upper deck and said lower deck and which interconnects said at least one cylinder and said coolant jacket in a manner which partitions said coolant jacket into cell-like compartments in which coolant stagnates; and means defining apertures in said upper deck through which the gaseous coolant produced by the boiling of the coolant in the compartments is transferred to said cavity.

2. An internal combustion engine as claimed in claim 1, further comprising web members which extend essentially normal to said rib member.

3. In an internal combustion engine a cylinder block;

means defining at least one cylinder in said cylinder block;

a cylinder head attached to said cylinder block in a manner to close one end of said at least one cylinder and define a combustion chamber therein;

means defining a coolant jacket in said cylinder block, said coolant jacket surrounding said at least one cylinder;

a condenser in which gaseous coolant is condensed to its liquid form;

means for communicating between said cylinder block and said condenser for introducing liquid coolant from said condenser into said coolant jacket;

means for collecting gaseous coolant produced by the boiling of the liquid coolant and introduced into said coolant jacket, said collecting means defining a cavity;

means for conveying the gaseous coolant collected in said cavity to said condenser for condensation therein;

an upper deck formed along the top of said cylinder block and against which said cylinder head is secured;

a lower deck formed along the bottom of said cylinder block;

at least one non-perforate rib member in said coolant jacket which extends from said lower deck toward said upper deck, which terminates short of said upper deck and which interconnects said cylinder and said coolant jacket in a manner which partitions said coolant jacket into cell-like compartments in which coolant stagnates; and means for transferring to said upper deck the gaseous coolant produced by the boiling of the coolant in the compartments, said transferring means defining an aperture in said upper deck.

4. In an internal combustion engine a cylinder block;

means defining at least one cylinder in said cylinder block;

a cylinder head attached to said cylinder block in a manner to close one end of said at least one cylinder and define a combustion chamber therein;

means defining a coolant jacket in said cylinder block, said coolant jacket surrounding said at least one cylinder;

a condenser in which gaseous coolant is condensed to its liquid form;

means for communicating between said cylinder block and said condenser for introducing liquid coolant from said condenser into said coolant jacket;

means for collecting gaseous coolant produced by the boiling of the liquid coolant and introduced into said coolant jacket, said collecting means defining a cavity;

means for conveying the gaseous coolant collected in said cavity to said condenser for condensation therein;

a lower deck formed along the bottom of said cylinder block; and at least one non-perforate rib member in said coolant jacket which extends from said lower deck to the top of said cylinder block, and which interconnects said cylinder and said coolant jacket in a manner which partitions said coolant jacket into cell-like compartments in which coolant stagnates.

5. In an internal combustion engine a cylinder block;

means defining at least one cylinder in said cylinder block;

a cylinder head attached to said cylinder block in a manner to close one end of said at least one cylinder and define a combustion chamber therein;

means defining a coolant jacket in said cylinder block, said coolant jacket surrounding said at least one cylinder;

a condenser in which gaseous coolant is condensed to its liquid form;

means for communicating between said cylinder block and said condenser for introducing liquid coolant from said condenser into said coolant jacket;

means for collecting gaseous coolant produced by the boiling of the liquid coolant and introduced into said coolant jacket, said collecting means defining a cavity;

means for conveying the gaseous coolant collected in said cavity to said condenser for condensation therein;

a lower deck formed along the bottom of said cylinder block;

at least one non-perforate rib member in said coolant jacket which extends from said lower deck to the top of said cylinder block, and which interconnects said cylinder and said coolant jacket in a manner which partitions said coolant jacket into cell-like compartments in which coolant stagnates; and a web formed at the top of said rib member and against which said cylinder head is secured, said web extending essentially normally to said rib member.

6. In an internal combustion engine a cylinder block;

means defining a plurality of cylinders in said cylinder block;

a cylinder head attached to said cylinder block in a manner to close one end of each of said cylinders in a manner which defines a plurality of combustion chambers;

means defining a coolant jacket in said cylinder block, said coolant jacket surrounding said cylinders;

a condenser in which gaseous coolant is condensed to its liquid form;

means for communicating between said cylinder block and said condenser for introducing liquid coolant from said condenser into said coolant jacket;

means for collecting gaseous coolant produced by the boiling of the liquid coolant and introduced into said coolant jacket, said collecting means defining a cavity;

means for conveying the gaseous coolant collected in said cavity to said condenser for condensation therein;

a lower deck formed along the bottom of said cylinder block;

a plurality of non-perforate rib members in said coolant jacket which extend from said lower deck to the top of said cylinder head, and which interconnect said cylinders and said coolant jacket defining means in a manner which partitions said coolant jacket into cell-like compartments in which coolant stagnates; and means defining blind bores in said rib members, said blind bores receiving head bolts which secure said cylinder head to said cylinder block.

* * * * *